US009110407B2

(12) United States Patent
Kiryu

(10) Patent No.: US 9,110,407 B2
(45) Date of Patent: Aug. 18, 2015

(54) BELT CONTROLLER, IMAGE FORMING APPARATUS, IMAGE FORMING METHOD, AND RECORDING MEDIUM STORING IMAGE FORMING CONTROL PROGRAM

(71) Applicant: Koji Kiryu, Kanagawa (JP)

(72) Inventor: Koji Kiryu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/177,071

(22) Filed: Feb. 10, 2014

(65) Prior Publication Data

US 2014/0255063 A1 Sep. 11, 2014

(30) Foreign Application Priority Data

Mar. 6, 2013 (JP) ..... 2013-043774

(51) Int. Cl.
*G03G 15/16* (2006.01)

(52) U.S. Cl.
CPC .. *G03G 15/1615* (2013.01); *G03G 2215/00143* (2013.01)

(58) Field of Classification Search
CPC ..... G03G 15/1615; G03G 2215/00156
USPC ..... 399/301, 302, 308
See application file for complete search history.

(56) References Cited

U.S. PATENT DOCUMENTS

| | | | | |
|---|---|---|---|---|
| 6,865,358 | B2 * | 3/2005 | Lee | 399/167 |
| 2010/0239293 | A1 | 9/2010 | Ishizaki et al. | |
| 2011/0013951 | A1 * | 1/2011 | Yonemoto | 399/302 |
| 2011/0229159 | A1 | 9/2011 | Kiryu | |
| 2012/0237240 | A1 | 9/2012 | Kiryu | |

FOREIGN PATENT DOCUMENTS

| | | |
|---|---|---|
| JP | 11-024507 | 1/1999 |
| JP | 11-295948 | 10/1999 |
| JP | 2000-034032 | 2/2000 |
| JP | 2000-266139 | 9/2000 |

* cited by examiner

*Primary Examiner* — Gregory H Curran
(74) *Attorney, Agent, or Firm* — Duft Bornsen & Fettig LLP

(57) ABSTRACT

A belt controller, an image forming apparatus, a belt controlling method, and a recording medium storing an image forming control program adjust a position of a belt. Each of the belt controller, the image forming apparatus, the belt controlling method, and the recording medium storing an image forming control program detects a position of the belt and transmits a position detection signal, determines whether a degree of misalignment of the belt is equal to or greater than a specified threshold before the belt starts moving based on the position detection signal, presses the belt to reduce the degree of misalignment of the belt when the degree of misalignment of the belt is equal to or greater than the specified threshold, and performs feedback control to adjust the position of the belt according to the degree of misalignment of the belt after pressing the belt.

8 Claims, 8 Drawing Sheets

BELT CONTROLLER, IMAGE FORMING APPARATUS, IMAGE FORMING METHOD, AND RECORDING MEDIUM STORING IMAGE FORMING CONTROL PROGRAM

CROSS-REFERENCE TO RELATED APPLICATION

This patent application is based on and claims priority pursuant to 35 U.S.C. §119 to Japanese Patent Application No. 2013-043774, filed on Mar. 6, 2013, in the Japan Patent Office, the entire disclosure of which is hereby incorporated by reference herein.

BACKGROUND

1. Technical Field

Example embodiments of the present invention generally relate to a belt controller, and more particularly to a belt controller, an image forming apparatus, an image forming method, and a recording medium storing an image forming control program that adjust lateral misalignment of a belt in the width direction perpendicular to the direction of rotation of the belt.

2. Background Art

Conventionally, the position of a rotating belt is corrected by detecting misalignment of the belt in the width direction perpendicular to the direction of rotation of the belt and controlling the inclination of a roller that supports the belt according to the degree of misalignment between the actual position of the belt and a desired position. This feedback control technique has been suggested as a method of adjusting the position of a belt provided for an image forming apparatus or the like.

FIG. 7 illustrates an example of such feedback control technique disclosed in JP-H11-295948-A. In FIG. 7, a belt drive compares the data detected by a belt edge sensor with edge-shape data, and corrects a positional change in the width direction of an intermediate transfer belt based on the result of correction.

SUMMARY

Disclosed embodiments provide an improved belt controller, image forming apparatus, belt controlling method, and recording medium storing an image forming control program that adjust a position of a belt. Each of the belt controller, the image forming apparatus, the belt controlling method, the recording medium storing an image forming program detects a position of the belt and transmits a position detection signal, determines whether a degree of misalignment of the belt is equal to or greater than a specified threshold before the belt starts moving based on the position detection signal, presses the belt to reduce the degree of misalignment of the belt when the degree of misalignment of the belt is equal to or greater than the specified threshold, and performs feedback control to adjust the position of the belt according to the degree of misalignment of the belt after pressing the belt.

BRIEF DESCRIPTION OF THE SEVERAL VIEWS OF THE DRAWINGS

A more complete appreciation of exemplary embodiments and the many attendant advantages thereof will be readily obtained as the same becomes better understood by reference to the following detailed description when considered in connection with the accompanying drawings.

Figure 1:
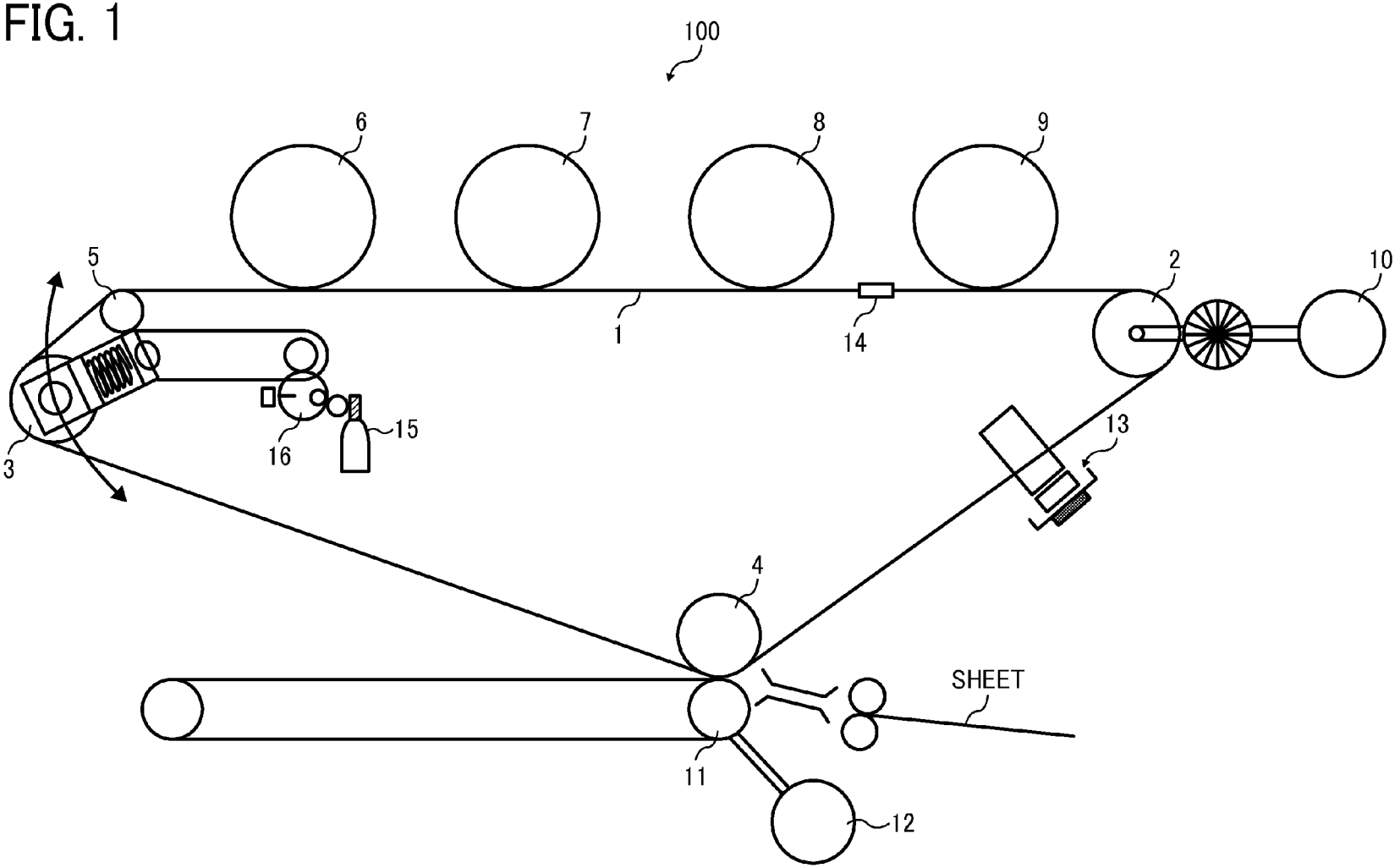
FIG. 1 illustrates a hardware configuration of an image forming apparatus according to an example embodiment of the present invention.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that have the same structure, operate in a similar manner, and achieve a similar result.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits (ASICs), field programmable gate arrays (FPGAs), or the like. These units may be collectively referred to as processors.

Embodiments of the present invention are described below. It is to be noted, however, that various applications and modifications thereof may be made thereto without departing from the scope of the invention.

FIG. 1 illustrates the hardware configuration of an image forming apparatus 100 according to an example embodiment of the present invention.

The image forming apparatus 100 is a tandem image forming apparatus. The image forming apparatus 100 includes an intermediate transfer belt 1, a drive roller 2, a steering roller 3, a repulsion roller 4, a driven roller 5, photoreceptor drums 6, 7, 8, and 9, drive motors 10 and 12, a transfer roller 11, an edge sensor 13, a pair of overrun sensors 14, a steering motor 15, and an eccentric cam 16.

The intermediate transfer belt 1 is supported by rollers including the drive roller 2, the steering roller 3, the repulsion roller 4, and the driven roller 5. The intermediate transfer belt 1 rotates due to the driving force caused by the drive motor 10, and toner is applied to the intermediate transfer belt 1 by the photoreceptor drums 6, 7, 8, and 9.

The steering roller 3 corrects misalignment of the intermediate transfer belt 1. The steering roller 3 moves an end of the steering roller 3 on the front or rear side of the image forming apparatus 100 upward or downward by the driving force of the steering motor 15 conveyed via the eccentric cam 16, to press the intermediate transfer belt 1 to the front or rear side of the image forming apparatus 100 to correct any misalignment of the intermediate transfer belt 1.

The edge sensor 13 detects edge positions of the intermediate transfer belt 1. The edge sensor 13 transmits a signal indicating the edge positions of the intermediate transfer belt 1 to a feedback controller 21, which will be described later.

The overrun sensors 14 detect an excessive misalignment of the intermediate transfer belt 1. The overrun sensors 14 are arranged on the front and rear sides of the intermediate transfer belt 1, respectively. When an excessive misalignment of the intermediate transfer belt 1 is detected, the overrun sensors 14 transmit a signal that indicates the presence of the misalignment.

The image forming apparatus 100 includes a processor such as a CPU (central processing unit) and a MPU (microprocessing unit), and executes a program that is described by program language such as assembler language, C, C++, Java (registered trademark), JavaScript (registered trademark), PERL, RUBY, and PYTHOM under the control of an OS (operating system) such as UNIX (registered trademark), LINUX (registered trademark), WINDOWS (registered trademark) OS, ITRON, VxWORKs, QNX, and Enea OSE. Moreover, the image forming apparatus 100 includes a RAM that provides an area for executing a program, or memory capable of permanently storing a program or data, and realizes functions of a belt controller 200, described below, by executing a program.

Figure 2:
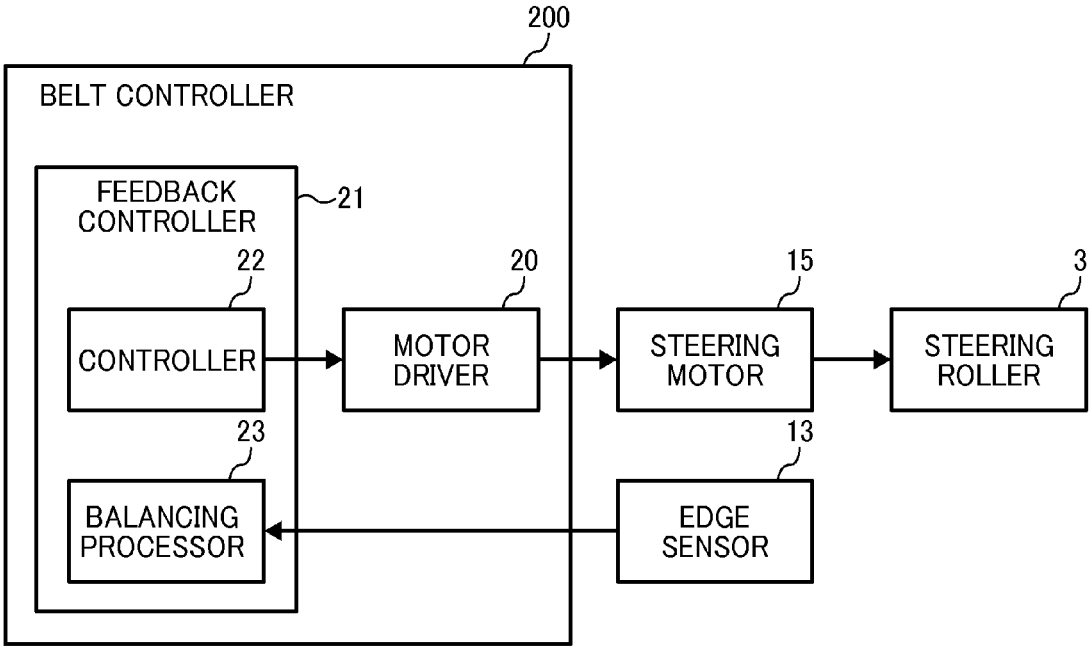
FIG. 2 illustrates a functional configuration of a belt controller provided for the image forming apparatus of FIG. 1, according to an embodiment of the present invention.

FIG. 2 illustrates a functional configuration of the belt controller 200 provided for the image forming apparatus 100 of FIG. 1.

The belt controller 200 includes a motor driver 20 and the feedback controller 21. The motor driver 20 controls the operation of the steering motor 15 and the drive motors 10 and 12 under the control of the feedback controller 21. The motor driver 20 moves an end of the steering roller 3 upward or downward by controlling the steering motor 15 to adjust the tilt angle of the steering roller 3. Moreover, the motor driver 20 controls the drive motor 10 such that the intermediate transfer belt 1 rotates. In the present example embodiment, the motor driver 20 may be implemented as a semiconductor device such as an ASIC. Alternatively, the motor driver 20 may be implemented as a software program executed by the image forming apparatus 100 in other embodiments.

The feedback controller 21 includes a controller 22 and a balancing processor 23.

The balancing processor 23 calculates the degree of misalignment of the intermediate transfer belt 1. More specifically, the balancing processor 23 uses the position of an edge of the intermediate transfer belt 1 detected by and received from the edge sensor 13 to calculate the degree of misalignment of the intermediate transfer belt 1. Then, the balancing processor 23 balances the degree of misalignment caused during a specified period, and provides the balanced degree of misalignment for the controller 22.

The controller 22 controls the motor driver 20 to adjust the position of the intermediate transfer belt 1 by using the calculated degree of misalignment. The controller 22 determines whether the degree of misalignment of the intermediate transfer belt 1 is equal to or greater than a specified threshold before driving the intermediate transfer belt 1. When the degree of misalignment is equal to or greater than a specified threshold, the controller 22 controls the tilt of the steering roller 3 via the motor driver 20 and the steering motor 15 so as to reduce the degree of misalignment, and thereby presses the intermediate transfer belt 1. Then, the controller 22 drives the intermediate transfer belt 1, and performs a feedback control process according to the degree of misalignment of the intermediate transfer belt 1. Accordingly, the degree of misalignment of the intermediate transfer belt 1 is adjusted. The processes that are performed by the controller 22 will be described later in detail with reference to FIGS. 3 and 5.

In the present example embodiment, the feedback controller 21 is implemented as a software program. However, the feedback controller 21 may be implemented as a semiconductor device in other embodiments.

Figure 3:
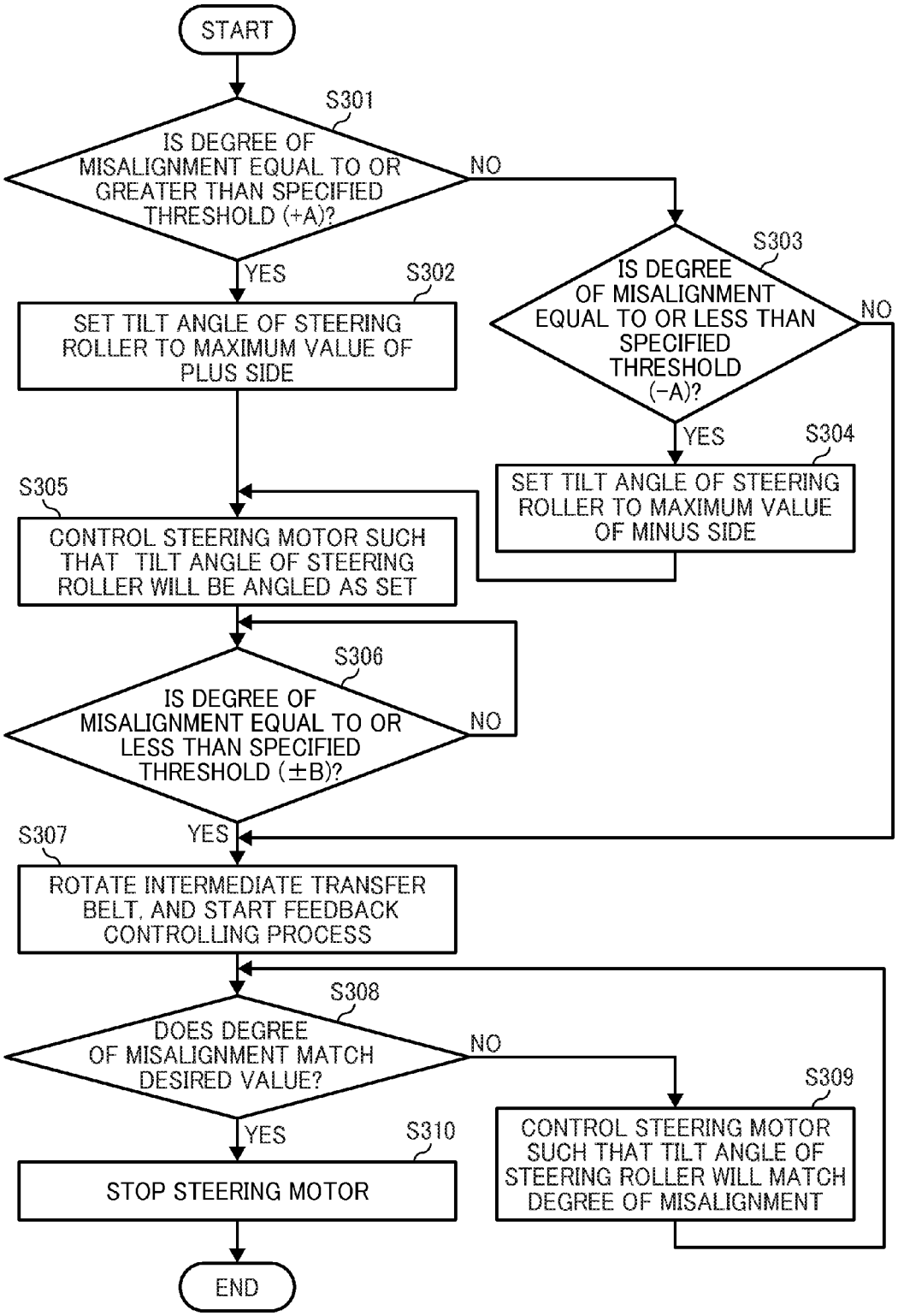
FIG. 3 is a flowchart illustrating the processes performed by the belt controller of FIG. 2, according an embodiment of the present invention.

An embodiment of a belt position adjusting method used by the feedback controller 21 of the belt controller 200 is described below with reference to FIG. 3. FIG. 3 is a flowchart illustrating the processes performed by the belt controller 200 according an embodiment of the present invention.

In step S301, the controller 22 of the feedback controller 21 determines whether or not the degree of misalignment of the intermediate transfer belt 1 output from the balancing processor 23 is equal to or greater than a specified threshold (positive value (+A)).

In the present example embodiment, the degree of misalignment of the intermediate transfer belt 1 is expressed as positive and negative values. A positive value for the degree of misalignment indicates that the intermediate transfer belt 1 is shifted towards the front of the image forming apparatus 100, and a negative value for the degree of misalignment indicates that the intermediate transfer belt 1 is shifted towards the rear of the image forming apparatus 100. Preferably, the specified threshold (+A) is equal to the degree of misalignment that may lead to a contact between the intermediate transfer belt 1 and the overrun sensor 14 on the front side of the image forming apparatus 100, which is caused as the intermediate transfer belt 1 shifts to the front side of the image forming apparatus 100 due to the initiated movement of the intermediate transfer belt 1.

When the degree of misalignment is equal to or greater than the specified threshold (+A) ("YES" in S301), the process shifts to step S302. In step S302, the controller 22 instructs the motor driver 20 to set the tilt angle of the steering roller 3 to the maximum value of the plus side. As the tilt angle of the steering roller 3 is set to the maximum value of the plus side, the edge of the steering roller 3 on the front side of the image forming apparatus 100 is lifted. The tilt angle of the steering roller 3 is set to the maximum value on the plus side in the present example embodiment, but any angle may be set in other embodiments as long as the degree of misalignment of the intermediate transfer belt 1 is reliably reduced.

When the degree of misalignment is determined to be less than the specified threshold (+A) ("NO" in S301), the process shifts to step S303. In step S303, the controller 22 of the feedback controller 21 determines whether or not the degree of misalignment of the intermediate transfer belt 1 is equal to or less than a specified threshold (negative value (−A)). Preferably, the specified threshold (−A) is equal to the degree of misalignment that may lead to a contact between the intermediate transfer belt 1 and the overrun sensor 14 on the rear side of the image forming apparatus 100, which is caused by the initiated movement of the intermediate transfer belt 1.

When the degree of misalignment is not equal to or less than the specified threshold (−A) ("NO" in S303), the process shifts to step S307. On the other hand, when the degree of misalignment is equal to or less than the specified threshold (−A) ("YES" in S303), the process shifts to step S304.

In step S304, the controller 22 instructs the motor driver 20 to set the tilt angle of the steering roller 3 to the maximum value of the minus side. As the tilt angle of the steering roller 3 is set to the maximum value of the minus side, the edge of the steering 3 on the rear side of the image forming apparatus 100 is lifted. The tilt angle of the steering roller 3 is set to the maximum value of the minus side in the present example embodiment, but any angle may be set as long as the degree of misalignment of the intermediate transfer belt 1 is reliably reduced.

In step S305, the controller 22 drives the steering motor 15 through the motor driver 20, and controls the steering motor 15 such that the tilt angle of the steering roller 3 will be angled as set in step S302 or S304. Accordingly, the steering motor 15 and the steering roller 3 press the intermediate transfer belt 1 to reduce the degree of misalignment.

In step S306, the controller 22 of the feedback controller 21 determines whether or not the degree of misalignment of the intermediate transfer belt 1 after the pressing process of the intermediate transfer belt 1 is equal to or less than a specified threshold (±B). The specified threshold (±B) is equal to a degree of misalignment that does not lead to a contact between the intermediate transfer belt 1 and the overrun sensor 14, which is caused by the initiated movement of the intermediate transfer belt 1.

When the degree of misalignment is not equal to or less than the specified threshold (±B) ("NO" in S306), the process of step S306 is repeated until the degree of misalignment becomes equal to or less than the specified threshold (±B). On the other hand, when the degree of misalignment is equal to or less than the specified threshold (±B) ("YES" in S306), the process shifts to step S307.

In step S307, the controller 22 rotates the intermediate transfer belt 1 by driving the drive motor 10 through the motor driver 20, and then starts a feedback control process of steps S308 and S309. In the present example embodiment, the controller 22 starts the feedback control process upon setting the tilt angle of the steering roller 3 to "0".

In step S308, the controller 22 determines whether or not the degree of misalignment of the intermediate transfer belt 1 matches a desired value by comparing the desired value with the degree of misalignment of the intermediate transfer belt 1 detected after the intermediate transfer belt 1 has started moving. When the degree of misalignment does not match the desired value ("NO" in S308), the process shifts to step S309.

In step S309, the controller 22 controls the steering motor 15 through the motor driver 20 such that the tilt angle of the steering roller 3 will match the detected degree of misalignment, and then returns the process to step S308. Note that the tilt angle that matches the detected degree of misalignment indicates the tilt angle of the steering roller 3 that can be adjusted to reduce the degree of misalignment, and thus such a tilt angle gradually decreases as the degree of misalignment decreases. The feedback control processes in steps S308 and S309 are repeated until the degree of misalignment reaches a desired value.

When the degree of misalignment matches the desired value ("YES" in S308), the feedback control processes terminate and the process shifts to step S310. In step S310, the controller 22 stops the steering motor 15 through the motor driver 20, and then the process terminates.

Figure 4:
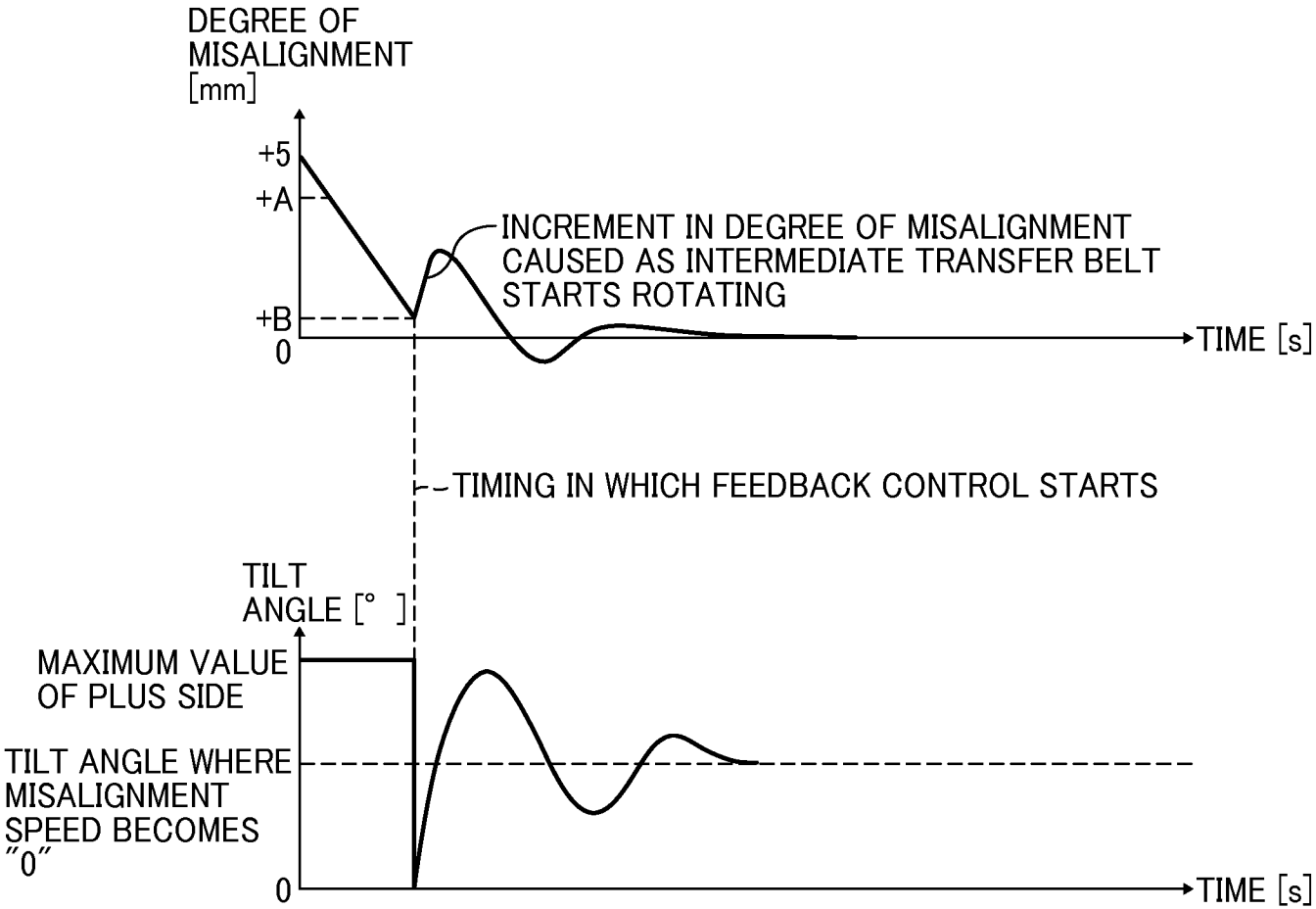
FIG. 4 illustrates how the degree of misalignment of an intermediate transfer belt changes and how the tilt angle of a steering roller changes when the belt position adjusting method of FIG. 3 is used.

FIG. 4 illustrates how the degree of misalignment of the intermediate transfer belt 1 changes and how the tilt angle of the steering roller 3 changes when the belt position adjusting method of FIG. 3 is used.

In an example embodiment illustrated in FIG. 4, the degree of misalignment at time "0" is greater than a threshold (+A). Thus, the controller 22 of the feedback controller 21 sets the tilt angle of the steering roller 3 to the maximum value of the plus side. Accordingly, the degree of misalignment of the intermediate transfer belt 1 gradually decreases, and when the degree of misalignment reaches a threshold (+B), the controller 22 controls the intermediate transfer belt 1 to rotate and starts a feedback control. In the present example embodiment, the tilt angle of the steering roller 3 at the time when the feedback control starts is "0".

As the intermediate transfer belt 1 rotates, the friction force between the intermediate transfer belt 1 and various rollers decreases. For this reason, the degree of misalignment of the intermediate transfer belt 1 temporarily increases. The controller 22 controls the tilt angle of the steering roller 3 to reduce the degree of misalignment by performing a feedback control, and makes the degree of misalignment converge to "0". As a result, the tilt angle of the steering roller 3 after the feedback control is angled such that the misalignment speed, which is the moving velocity of the intermediate transfer belt 1 in the width direction, becomes "0". In other words, the tilt angle of the steering roller 3 is angled such that the degree of misalignment becomes "0".

As described above, the degree of misalignment of a belt is reduced before a feedback control is initiated according to an example embodiment of the present invention. Accordingly, an excessive misalignment of the belt caused when the belt starts moving can be prevented. Moreover, the time it takes for the belt to converge to a desired position can be reduced. Further, a belt that has started moving can be prevented from contacting the overrun sensor 14.

Figure 5A:
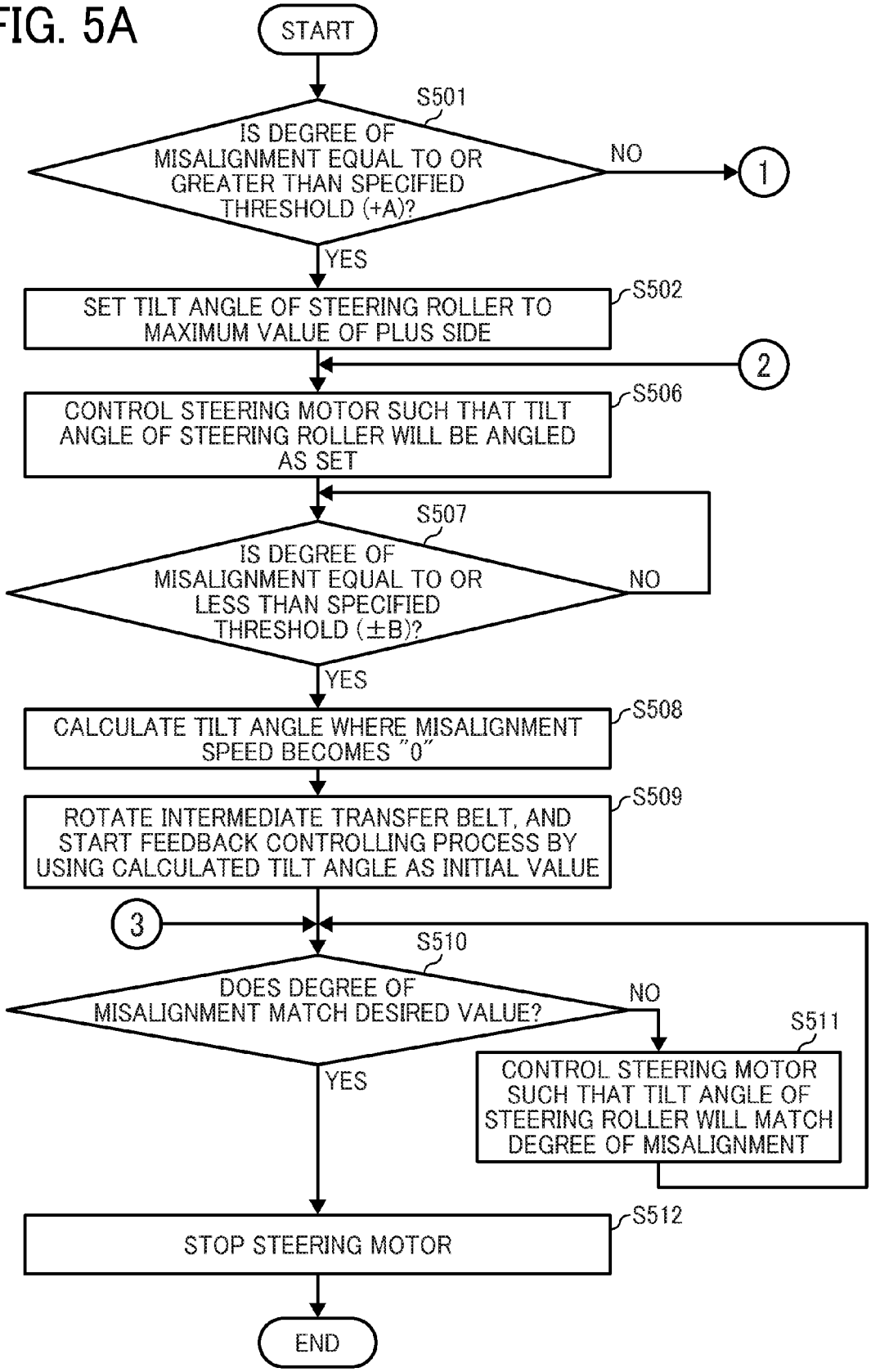
FIGS. 5A and 5B are a set of flowcharts illustrating the processes performed by the belt controller of FIG. 2, according another embodiment of the present invention.
Figure 5B:
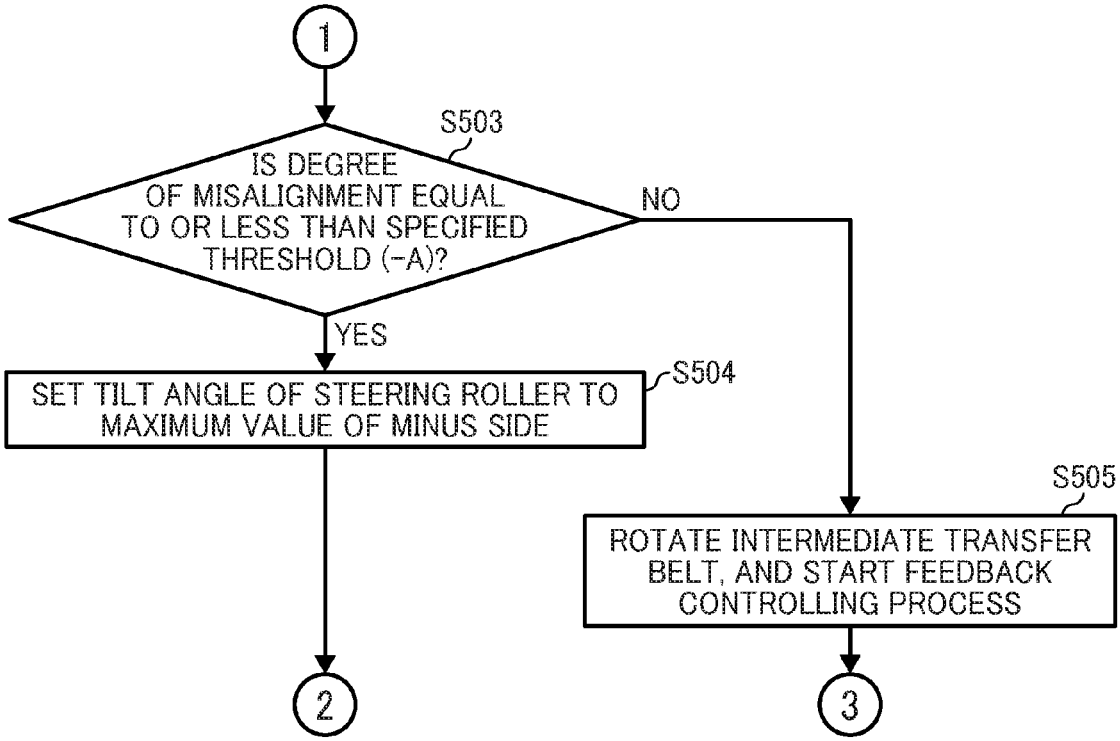

Another embodiment of a belt position adjusting method used by the feedback controller 21 of the belt controller 200 is described below with reference to FIGS. 5A and 5B. FIGS. 5A and 5B are a set of flowcharts illustrating the processes performed by the belt controller 200 according an embodiment of the present invention. A description of elements similar to those of FIG. 3 will be omitted.

In step S501, the controller 22 of the feedback controller 21 determines whether or not the degree of misalignment of the intermediate transfer belt 1 output from the balancing processor 23 is equal to or greater than a specified threshold (positive value (+A)). When the degree of misalignment is equal to or greater than the specified threshold (+A) ("YES" in S501), the process shifts to step S502. In step S502, the controller 22 instructs the motor driver 20 to set the tilt angle of the steering roller 3 to the maximum value of the plus side.

When the degree of misalignment is determined to be less than the specified threshold (+A) ("NO" in S501), the process shifts to step S503. In step S503, the controller 22 of the feedback controller 21 determines whether or not the degree of misalignment of the intermediate transfer belt 1 is equal to or less than a specified threshold (negative value (−A)). When the degree of misalignment is equal to or less than the specified threshold (−A) ("YES" in S503), the process shifts to step S504. In step S504, the controller 22 instructs the motor driver 20 to set the tilt angle of the steering roller 3 to the maximum value of the minus side.

When the degree of misalignment is not equal to or less than the specified threshold (−A) ("NO" in S503), the process shifts to step S505. In step S505, the controller 22 rotates the intermediate transfer belt 1 by driving the drive motor 10 through the motor driver 20, and then starts a feedback control process.

In step S506, the controller 22 drives the steering motor 15 through the motor driver 20, and controls the steering motor 15 such that the tilt angle of the steering roller 3 will be angled as set in step S502 or S504.

In step S507, the controller 22 of the feedback controller 21 determines whether or not the degree of misalignment of the intermediate transfer belt 1 after the pressing process of the intermediate transfer belt 1 is equal to or less than a specified threshold (±B). When the degree of misalignment is not equal to or less than the specified threshold (±B) ("NO" in S507), the process of step S507 is repeated until the degree of misalignment becomes equal to or less than the specified threshold (±B). On the other hand, when the degree of misalignment is equal to or less than the specified threshold (±B) ("YES" in S306), the process shifts to step S508.

In step S508, the controller 22 calculates the tilt angle of the steering roller 3 where the misalignment speed becomes "0". The controller 22 can calculate a tilt angle (X) where the misalignment speed becomes "0" by using formula 1.

$$X = X_{max} - \frac{Y_{max}}{a} \quad \text{[Formula 1]}$$

$Y_{max}$=CHANGE IN DEGREE OF MISALIGNMENT/TIME

In Formula 1, $X_{max}$ indicates the largest tilt angle. $Y_{max}$ indicates the change in the degree of misalignment when the tilt angle is the largest at $X_{max}$. Constant "a" indicates a fixed value of a system that is determined by an environmental factor such as the rotation speed of the intermediate transfer belt 1.

In the present example embodiment, the initial value is set to a tilt angle where the misalignment speed becomes "0". However, when PI (proportional-integral) control is employed as feedback control, a value may be determined according to the tilt angle where the misalignment speed becomes "0".

In step S509, the controller 22 rotates the intermediate transfer belt 1 by driving the drive motor 10 through the motor driver 20, and then starts feedback control processes of steps S510 and S511 by using the tilt angle calculated in step S508 as the initial value. In the present example embodiment, the controller 22 controls the steering motor 15 and the steering roller 3 to start a feedback control process while pressing the intermediate transfer belt 1 with pressing force that makes the misalignment speed become "0".

In step S510, the controller 22 determines whether or not the degree of misalignment of the intermediate transfer belt 1 matches a desired value by comparing the desired value with the degree of misalignment of the intermediate transfer belt 1 detected after the intermediate transfer belt 1 has started moving. When the degree of misalignment does not match the desired value ("NO" in S510), the process shifts to step S511. In step S511, the controller 22 controls the steering motor 15 through the motor driver 20 such that the tilt angle of the steering roller 3 will match the detected degree of misalignment, and then returns the process to step S510. The feedback control processes in steps S510 and S511 are repeated until the degree of misalignment reaches the desired value.

When the degree of misalignment matches the desired value ("YES" in S510), the feedback control processes terminate and the process shifts to step S512. In step S512, the controller 22 stops the steering motor 15 through the motor driver 20, and then the process terminates.

Figure 6:
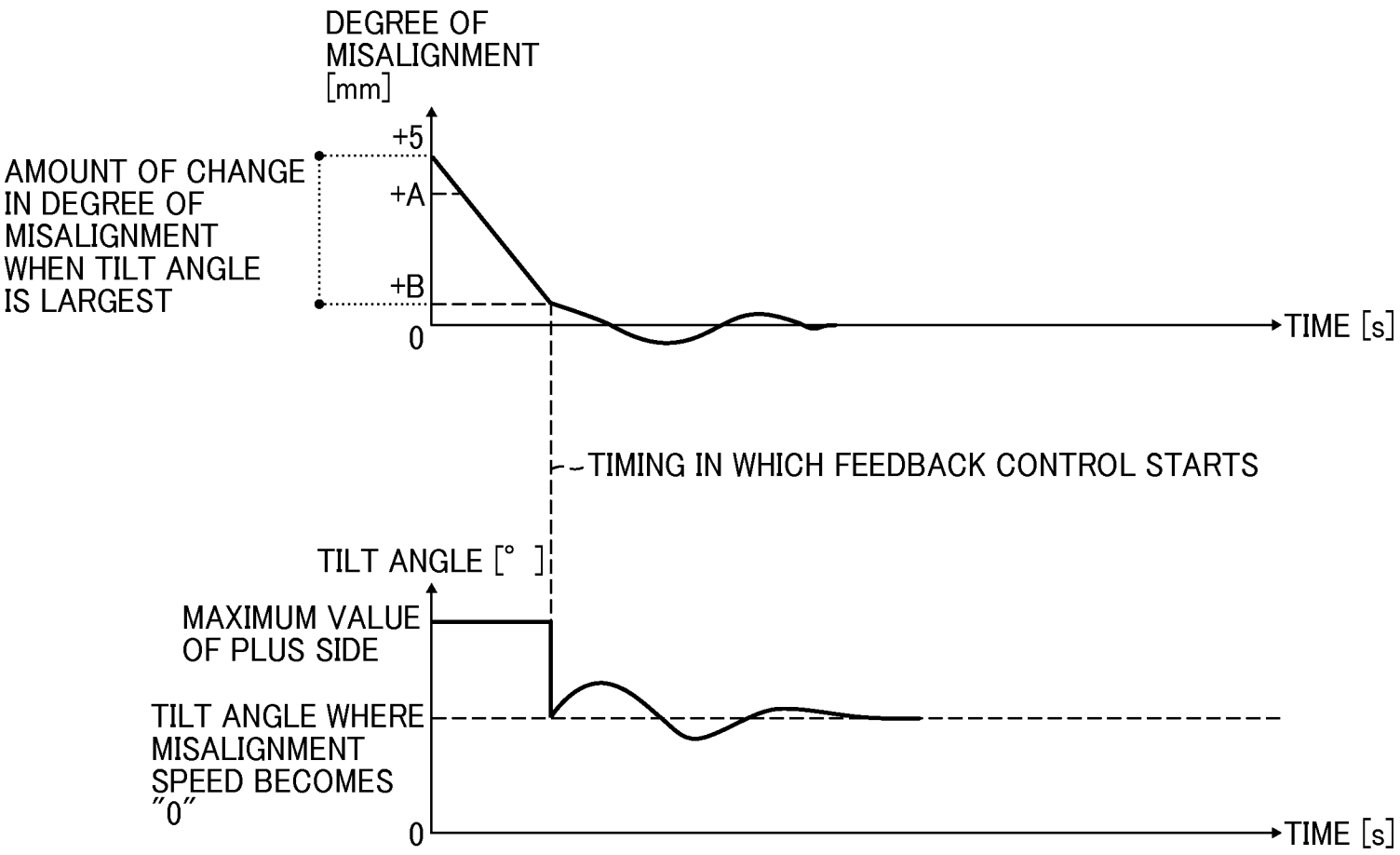
FIG. 6 illustrates how the degree of misalignment of an intermediate transfer belt changes and how the tilt angle of a steering roller changes when the belt position adjusting method of FIGS. 5A and 5B is used.
Figure 7:
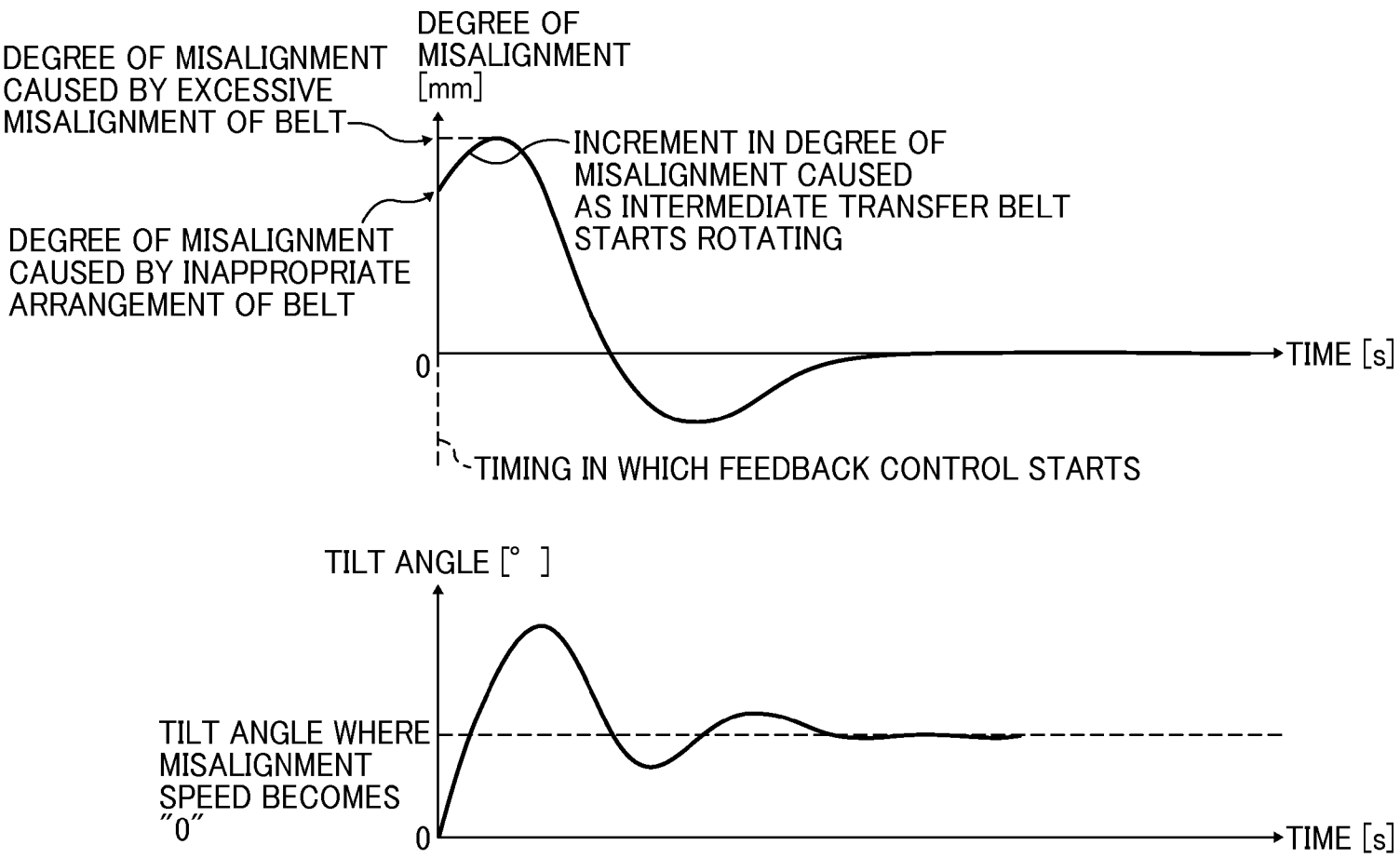
FIG. 7 PRIOR ART
FIG. 7 illustrates how the degree of misalignment of an intermediate transfer belt changes and how the tilt angle of a steering roller changes when a conventional belt position adjusting method is used.

FIG. 6 illustrates how the degree of misalignment of the intermediate transfer belt 1 changes and how the tilt angle of the steering roller 3 changes when the belt position adjusting method of FIGS. 5A and 5B is used.

In an example embodiment illustrated in FIG. 6, the degree of misalignment at time "0" is greater than a threshold (+A) in a similar manner to FIG. 4. Thus, the controller 22 of the feedback controller 21 sets the tilt angle of the steering roller 3 to the maximum value of the plus side. Accordingly, the degree of misalignment of the intermediate transfer belt 1 gradually decreases, and when the degree of misalignment reaches a threshold (+B), the controller 22 calculates the tilt angle of the steering roller 3 where the misalignment speed becomes "0". Then, the controller 22 controls the intermediate transfer belt 1 to rotate, and starts a feedback control where the initial value is set to the calculated tilt angle.

The controller 22 controls the tilt angle of the steering roller 3 to reduce the degree of misalignment by performing a feedback control, and makes the degree of misalignment converge to "0". As a result, the tilt angle of the steering roller 3 after a feedback control is angled in such a manner that the misalignment speed becomes "0". In other words, the tilt angle of the steering roller 3 is angled in such a manner that the degree of misalignment becomes "0".

As described above, the degree of misalignment of the belt is reduced before a feedback control is initiated and the tilt angle of the steering roller 3 at the time when a feedback control is initiated is angled in such a manner that the misalignment speed becomes "0" in the present example embodiment. Accordingly, the degree of misalignment caused as the belt starts moving can be prevented, and the degree of misalignment can efficiently be reduced. Moreover, the time it takes for the belt to converge to a desired position can further be reduced.

The present invention has been described with reference to embodiments, but it should be understood that the present invention is not limited to those embodiments and various applications and modifications may be made by those skilled in the art. For example, some elements of those embodiments may be modified or deleted, or alternative elements may be added to the embodiments of the present invention. Any mode may be included in the scope of the present invention as long as effects of the present invention are achieved therein. In the embodiments described above, an intermediate transfer belt is referred to as an object that is controlled by a belt controller. However, an object to be controlled by a belt controller is not limited to an intermediate transfer belt, and other kinds of belts such as a fixing belt or a direct transfer belt used instead of a photoreceptor drum may be controlled. Moreover, it is to be noted that the belt according to the embodiments of the present invention is not limited to belts used for image forming apparatuses, but may be applied to other kinds of belts such as ones used for conveyers.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, nonvolatile memory cards, ROM (read-only-memory), etc. Alternatively, any one of the above-described and other methods of the present invention may be implemented by ASICs, prepared by interconnecting an appropriate network of conventional component circuits, or by a combination thereof with one or more conventional general-purpose microprocessors and/or signal processors programmed accordingly.

What is claimed is:

1. A belt controller that adjusts a position of a belt, the belt controller comprising:

a position detector to detect a position of the belt and transmit a position detection signal; and a determining device configured to determine a degree of misalignment of the belt based on the position detection signal;

the determining device configured to cause a motor driver to initiate a tilt of the belt independent of feedback control when the degree of misalignment exceeds a threshold to reduce the degree of misalignment before rotation of the belt is initiated, and to initiate feedback control that positions the belt based on the degree of misalignment when or after rotation of the belt is initiated.

2. The belt controller according to claim 1, wherein the determining device is configured to initiate rotation of the belt responsive to reducing the degree of misalignment below the threshold.

3. The belt controller according to claim 2, wherein the determining device is configured to initiate rotation of the belt responsive to reducing the degree of misalignment to a range that is below the threshold.

4. An image forming apparatus comprising the belt controller according to claim 1.

5. A method performed by a belt controller that adjusts a position of a belt, the method comprising:

detecting a position of the belt and transmitting a position detection signal;

determining a degree of misalignment of the belt based on the position detection signal;

initiating a tilt of the belt independent of feedback control when the degree of misalignment exceeds a threshold to reduce the degree of misalignment before rotation of the belt is initiated; and initiating feedback control that positions the belt based on the degree of misalignment when or after the rotation of the belt is initiated.

6. The method according to claim 5, further comprising:

initiating rotation of the belt responsive to reducing the degree of misalignment below the threshold.

7. The method according to claim 6, further comprising:

initiating rotation of the belt responsive to reducing the degree of misalignment to a range that is below the threshold.

8. A computer-readable non-transitory recording medium having stored therein a program that enables a belt controller to perform a method of adjusting a position of a belt, the method comprising:

detecting a position of the belt and transmitting a position detection signal;

determining a degree of misalignment of the belt based on the position detection signal;

initiating a tilt of the belt independent of feedback control when the degree of misalignment exceeds a threshold to reduce the degree of misalignment before rotation of the belt is initiated; and initiating feedback control that positions the belt based on the degree of misalignment when or after the rotation of the belt is initiated.

* * * * *